United States Patent [19]

Anderson

[11] Patent Number: 4,953,340

[45] Date of Patent: Sep. 4, 1990

[54] BAR SUPPORT FOR CONCRETE

[75] Inventor: Howard A. Anderson, Pittsburgh, Pa.

[73] Assignee: Mobay Corporation, Pittsburgh, Pa.

[21] Appl. No.: 366,986

[22] Filed: Jun. 16, 1989

[51] Int. Cl.[5] ..... E04C 5/07

[52] U.S. Cl. ..... 52/684; 52/687; 404/136

[58] Field of Search ..... 404/70, 100, 134, 135, 404/136; 52/677, 678, 679, 684, 369, 370, 364, 687

[56] References Cited

U.S. PATENT DOCUMENTS

| | | | |
|---|---|---|---|
| 1,512,906 | 10/1924 | Burrell | 404/136 |
| 1,651,946 | 12/1927 | Burrell | 404/135 X |
| 1,882,499 | 10/1932 | Johns | 52/679 X |
| 2,902,742 | 9/1959 | Matich | 404/136 X |
| 3,114,221 | 12/1963 | Eriksson | 50/514 |

FOREIGN PATENT DOCUMENTS

| | | | |
|---|---|---|---|
| 1484980 | 1/1969 | Fed. Rep. of Germany | 52/677 |
| 2831608 | 1/1980 | Fed. Rep. of Germany | 52/677 |
| 1420975 | 11/1965 | France | 52/677 |

*Primary Examiner*—Richard E. Chilcot, Jr.
*Assistant Examiner*—Jerrold D. Johnson
*Attorney, Agent, or Firm*—Joseph C. Gil; Aron Preis

[57] ABSTRACT

The rod-support chair of the present invention comprises a plastic channel made of a thermoplastic resin preferably selected from the group consisting of polycarbonate, aromatic polyester carbonate and aromatic polyesters. The channel is further characterized in that its physical dimensions and material properties permit its elastic and bending across its long dimension around at least part of the circumferential cross-section of a reinforcing rod and provide support for the rod for a period which is necessary for the concrete to set. The channel in its "in use" configuration is left in the cured, or set concrete and does not interfere with the setting process nor does it contribute to rust formation.

6 Claims, 1 Drawing Sheet

BAR SUPPORT FOR CONCRETE

FIELD OF THE INVENTION

The present invention relates to reinforced concrete technology and more particularly to means to support the reinforcement.

BACKGROUND OF THE INVENTION

In the manufacture of reinforced concrete structures steel rods are supported, in a horizontal orientation, by any of a variety of means. Where the supports are made of metal there is often formation of rust which is objectionable from the mechanical and aesthetical view points. The art is noted to include U.S. Pat. No. 3,114,221 which disclosed a rod-supporting chair which serves in supporting at a predetermined level above a subgrade a series of reinforcing rods in connection with a concrete paving installation.

It is an object of the present invention to provide a supporting chair for steel reinforcing rods and the like, sometimes referred to in the relevant art as a "re-bar chair", which is useful in the preparation of reinforced concrete.

It is a further object of the invention to provide a supporting chair for reinforcing rods which are commonly used in the fabrication of reinforced concrete.

It is a further object of the invention to provide support for horizontally oriented reinforcing rods used for concrete applications.

Another principal object of the invention is to provide a rod supporting chair which features a novel locking means for retaining the reinforcing rod in position.

A yet another object of the invention is to provide a supporting chair for reinforcing rods which is essentially of a one-piece construction.

A still further object of the invention is to provide a rod-supporting chair having associated therewith a rod-receiving cradle which is an integral part of the chair.

This and other objects are met by the present invention as describe below.

SUMMARY OF THE INVENTION

The present invention is directed to a chair for maintaining and supporting a cylindrical, horizontally extending, reinforcing rod in a fixed position in connection with a concrete installation. The chair comprise a thermoplastically molded or extruded channel having two integrally molded, preferably vertical side walls—flanges—running along its long dimension, each of which walls includes a cut section which permits bending the channel across its long dimension to form a cradle of reasonably tight fit around at least part of the circumferential cross-section of a reinforcing rod. The chair further contains means to secure its shape when in use.

DETAILED DESCRIPTION OF THE INVENTION

The rod-support re-bar chair of the present invention is best described by reference to FIGS. 1, 2 and 3.

Figure 1:
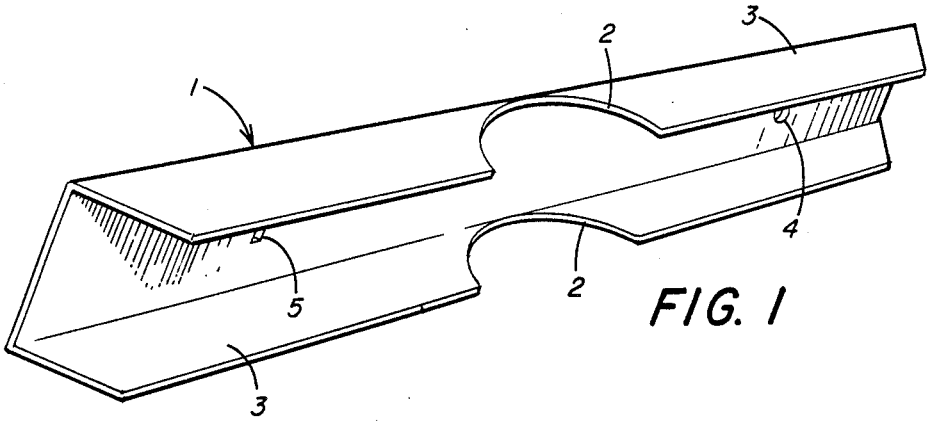

In FIG. 1 there is shown the chair of the invention in its pre-use un-bent configuration.

Figure 2:
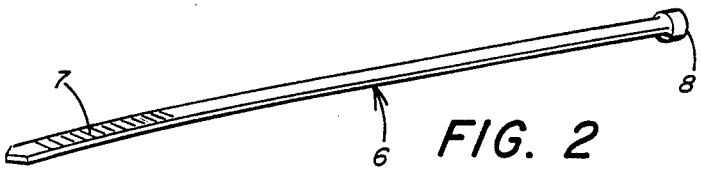

In FIG. 2 there is shown a strap used for fastening the legs of the chair upon use.

Figure 3:
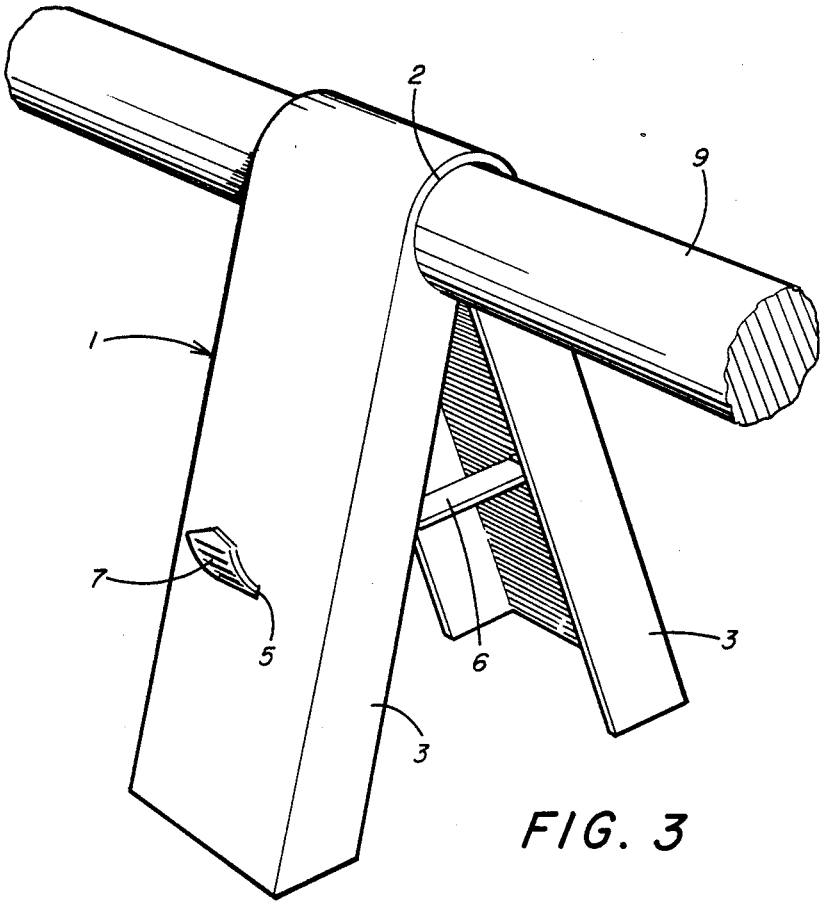

In FIG. 3 there is shown one of the rod supporting chairs of the present invention operatively associated with a reinforcing rod.

Referring to the drawings in detail and in particular to FIG. 1, the chair in its pre-use configuration comprises a plastic channel 1, having two vertical side walls 3, running along its long dimension preferably parallel one to the other. In the center of each of said side walls there is cut from the edge of the wall, a section having a semi-elliptical or a semicircular shape 2, which forms, when the channel is bent across its long dimension to form the chair of the invention, a reasonably tight fit around at least part of the circumference of the cross-section of the reinforcing rod. The cut, molded-in or drilled hole 4, and the corresponding aperture 5, are provided for the accommodation of the optional fastening strap 6, which is shown in FIG. 2. Further, in FIG. 2 there is represented the end 8, of the strap 6, which is, when in use, inserted through hole 4, and aperture 5. The striations 7 are indicated to aid in the locking the strap in place upon the use of the chair. The tightening strap is but one possible means to secure the legs of the chair in its "in-use", bent shape. Other means having the same function of locking the legs of the chair are well known in the art and are equally suitable in the context of the present invention.

In FIG. 3, there is represented the chair 1, in its "in-use" configuration wrapped around the circumferential cross-section of a reinforcing steel rod 9, and held in place by a tightening strap 6.

Typically, the shape of the chair formed upon bending the channel across its long dimension resembles the letter "A" where the reinforcing rod is held in place—cradled—at the joint formed between the legs of the "A". One advantageous rule to follow in forming the channel of the invention is to ensure that the legs of the chair once in use, form an angle of about 40° therebetween. Naturally, the optimum angle depends to a large degree on the material used to form the channel, the physical dimensions of the channel and the ultimate load it is designed to support. Channels having a length of up to 36 inches, made of polycarbonate by extrusion, and a wall thickness of about ⅛ inch designed to support a rod having a length of about 20-feet, the preferred angle is about 40°.

The chair of the invention is molded, preferably extruded, from a thermoplastic resin, preferably polycarbonate resin by methods well known in the art. The basic requirement is that the resin have adequate mechanical properties including in particular stiffness. While not a strict requirement for the successful use of the chair, it is preferred that the resin is chemically resistant to the alkaline environment which prevails in the interior of cement based products. Among the suitable resins for the preparation of the chair of the invention, mention may be made of polycarbonate, polyestercarbonate and aromatic polyester. The chair is best molded as a channel as shown in FIG. 1. The width of the channel, its wall thickness and the verticality of its side walls are not critical to the invention and the only requirement is that in its "in-use" configuration, the chair, as part of a set of chairs, be able to support the weight of the reinforcing rod. Typically, the channel is about one (1) to about one and a half (1½) inches wide; the wall thickness is typically in the order of 1/16 to about 3/16 inches, preferably ⅛inch. The cut out section 2, is positioned at the center of the wall at its free edge and forms upon the bending of the channel across its long dimension and around the cross-section of a reinforcing rod, a cradle having a suitable fit around at least part of the circumference of the rod. The cut out section may be either molded into the channel in a fashion well known in the art or cut into the channel in a separate operation. Likewise the hole 4, and aperture 5, may be formed by drilling or punching or they may be formed as an integral feature of the channel during molding.

It is to be noted that the chair of the invention may be manufactured in one operation using molding methods known in the art. Because of this factor and because the chair is made of primary one part and because it lends itself to easy assembly and put to use in a most economical fashion, the chair offers an attractive choice for reinforcing rods supports.

The invention is not to be limited to the exact arrangement and dimensions provided above for illustration purposes only, as changes in the details of the construction or of the fabrication of the chair are within the claims as stated below.

What is claimed is:

1. As an article of manufacture, a chair for maintaining and supporting a cylindrical, horizontally extending, reinforcing rod in a fixed position in connection with a concrete installation said chair comprising a thermoplastically molded or extruded channel having two side walls running along its long dimension, each of said walls having a section cut therefrom, said channel being sufficiently elastic to enable its bending across its long dimension to attain a shape enabling the embrace within said section, the at least partial circumferential cross-section of said reinforcing rod, said chair further containing means to secure said channel in said shape.

2. The article of claim 1 wherein said resin is selected from the group consisting of polycarbonate, aromatic polyester and polyester-carbonate.

3. The article of claim 1 wherein said resin is polycarbonate.

4. The article of claim 1 wherein said channel is molded by extrusion.

5. The article of claim 1 wherein said means to secure said channel comprises a serrated strip.

6. The article of claim 1 wherein said cut is a semielliptical.

* * * * *